US010016788B2

(12) United States Patent
Kato et al.

(10) Patent No.: US 10,016,788 B2
(45) Date of Patent: Jul. 10, 2018

(54) METHOD AND DEVICE FOR DRIVING CAPACITANCE TRANSDUCER

(71) Applicant: CANON KABUSHIKI KAISHA, Tokyo (JP)

(72) Inventors: Ayako Kato, Machida (JP); Kazutoshi Torashima, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 858 days.

(21) Appl. No.: 14/547,884

(22) Filed: Nov. 19, 2014

(65) Prior Publication Data

US 2015/0146502 A1 May 28, 2015

(30) Foreign Application Priority Data

Nov. 22, 2013 (JP) ..... 2013-242115

(51) Int. Cl.
*B06B 1/00* (2006.01)
*B06B 1/02* (2006.01)

(52) U.S. Cl.
CPC ..... *B06B 1/0292* (2013.01); *B06B 1/0207* (2013.01); *B06B 2201/20* (2013.01)

(58) Field of Classification Search
USPC ..... 367/137
See application file for complete search history.

(56) References Cited

U.S. PATENT DOCUMENTS 4,549,228 A * 10/1985 Dieterich ..... G11B 21/04 358/907
4,975,949 A * 12/1990 Wimsatt ..... H04M 1/312 379/387.01
8,363,514 B2 1/2013 Huang
8,767,278 B2 7/2014 Torashima et al.
8,875,583 B2 11/2014 Torashima et al.
9,089,874 B2 * 7/2015 Asafusa ..... A61B 8/4483
2003/0048698 A1 3/2003 Barnes et al.
(Continued)

FOREIGN PATENT DOCUMENTS

EP 2213239 A1 * 8/2010 ..... B06B 1/0215
JP 2006-020313 A 1/2006
(Continued)

OTHER PUBLICATIONS

Japanese Office Action dated Jun. 21, 2016 in Japanese Patent Application No. 2013-242115.
(Continued)

*Primary Examiner* — James R Hulka
(74) *Attorney, Agent, or Firm* — Fitzpatrick, Cella, Harper & Scinto

(57) ABSTRACT

Provided are a method, a device and the like for driving a capacitance transducer that enable reduction of transmission sound pressure variation caused by variation in characteristics of a capacitance transducer used for, e.g., an ultrasound conversion element. A method for driving a capacitance transducer including a plurality of elements each including cells each having a structure in which a vibration membrane including one electrode of a pair of electrodes formed with a cavity therebetween is supported in such a manner that the vibration membrane can vibrate is provided.

18 Claims, 9 Drawing Sheets

(56) References Cited

U.S. PATENT DOCUMENTS

| | | | | |
|---|---|---|---|---|
| 2006/0004289 | A1* | 1/2006 | Tian | B06B 1/0292 600/459 |
| 2010/0256498 | A1 | 10/2010 | Tanaka | |
| 2010/0268081 | A1* | 10/2010 | Asafusa | A61B 8/4483 600/437 |
| 2013/0313663 | A1 | 11/2013 | Kato et al. | |
| 2014/0007693 | A1 | 1/2014 | Torashima et al. | |
| 2014/0010052 | A1 | 1/2014 | Torashima et al. | |
| 2014/0010388 | A1 | 1/2014 | Akiyama et al. | |

FOREIGN PATENT DOCUMENTS

| | | | |
|---|---|---|---|
| JP | 2006-122344 | A | 5/2006 |
| JP | 2011-523234 | A | 8/2011 |
| WO | 2009-063964 | A1 | 5/2009 |
| WO | 2009-075280 | A1 | 6/2009 |
| WO | 2009/075280 | A1 | 4/2011 |

OTHER PUBLICATIONS

Japanese Office Action dated Sep. 12, 2017 in Japanese patent Application No. 2016184466.

* cited by examiner

METHOD AND DEVICE FOR DRIVING CAPACITANCE TRANSDUCER

BACKGROUND OF THE INVENTION

Field of the Invention

The present invention relates to a method, a device and the like for driving a capacitance transducer used as an ultrasound conversion element.

Description of the Related Art

Conventionally, micro mechanical members manufactured by micro machining techniques can be worked in the order of micro meters, and using such micro mechanical members, various micro functional elements are provided. Capacitance transducers formed using such techniques have been studied as alternatives to piezoelectric elements. These capacitance transducers enable transmission and reception of acoustic waves such as ultrasound waves (hereinafter, sometimes represented by ultrasound waves) using vibration of a vibration membrane facilitates provision of excellent wideband characteristics particularly in liquids. In the present specification, acoustic waves include what are called sound waves and ultrasound waves.

Ultrasound diagnostic apparatuses are apparatuses that transmit ultrasound waves from a capacitance transducer to a test object, receive reflected signals from the test object via the capacitance transducer and pick up ultrasound images based on the received signals. International Publication No. WO2009/075280 proposes suppression of reduction in sensitivity of the capacitance transducer due to a collapse state. Furthermore, Japanese Patent Application Laid-Open No. 2006-122344 makes a proposal relating to a method for driving a capacitance transducer, for an increase in the sound pressure of transmitted ultrasound waves and enhancement in the efficiency of reception of reflected signals.

A capacitance transducer is configured by a plurality of elements each including cells each having a structure in which a vibration membrane including one electrode of a pair of electrodes provided with a cavity therebetween is supported in such a manner that the vibration membrane can vibrate. The elements may vary in characteristics because of, e.g., variation in film thickness that occurs at a time of manufacture. If acoustic waves are transmitted by applying a same bias voltage to the plurality of elements and also applying a same transmission drive voltage to the plurality of elements, variation may occur in the strength of acoustic waves transmitted from the elements in the single capacitance transducer. The variation in the strength of transmitted acoustic waves causes variation in reflected waves from a test object, which may result in the distortion of the ultrasound images based on the received signals and/or a decrease in resolution.

As with the technique described in International Publication No. WO2009/075280, if transmission and reception are performed with a high bias voltage applied, the variation in the strength of transmitted acoustic waves may be larger because of nonlinear acoustic wave strength characteristics of the capacitance transducer. Furthermore, in the technique of Japanese Patent Application Laid-Open No. 2006-122344, the sensitivity of reception of reflected acoustic waves is adjusted by changing a bias voltage in a step-by-step manner in transmission and reception, which, however, cannot be said that the capacitance transducer is driven with the variation in the characteristics of a plurality of elements taken into account.

SUMMARY OF THE INVENTION

In view of the above problems, a method for driving a capacitance transducer according to the present invention is a method for driving a transducer including a plurality of elements each including a cell having a structure in which a vibration membrane including one electrode of a pair of electrodes formed with a cavity therebetween is supported in such a manner the vibration membrane can vibrate. The method includes, in a mode in which an element group that is at least a part of the plurality of elements receives acoustic waves, applying a voltage that is lower than a lowest voltage of pull-in voltages of the element group to the element group as a reception bias; and in a mode in which the element group transmits acoustic waves, applying a voltage that is lower than the reception bias to the element group as a transmission bias.

In view of the above problems, a device for driving a capacitance transducer according to the present invention is a device for driving a transducer including a plurality of elements each including a cell having a structure in which a vibration membrane including one electrode of a pair of electrodes formed with a cavity therebetween is supported in such a manner that the vibration membrane can vibrate. The device includes a voltage control unit that controls a voltage to be applied between the pair of electrodes. In a mode in which an element group that is at least a part of the plurality of elements receives acoustic waves, the voltage control unit applies a voltage that is lower than a lowest voltage of pull-in voltages of the element group to the element group as a reception bias. In a mode in which the element group transmits acoustic waves, a voltage that is lower than the reception bias is applied to the element group as a transmission bias.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In the present invention, in a mode in which an element group that is at least a part of a plurality of elements receives acoustic waves, a voltage that is lower than a lowest pull-in voltage of pull-in voltages of the respective elements in the element group is applied to the element group as a reception bias. In a mode in which the element group transmits acoustic waves, a voltage that is lower than the reception bias is applied to the element group as a transmission bias.

Figure 1A:
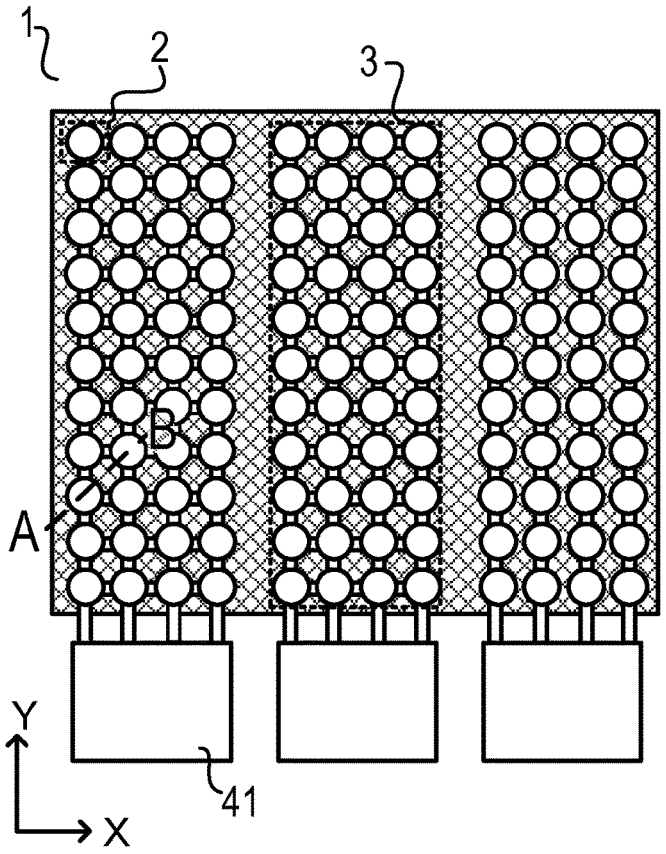
FIG. 1A is a top view illustrating an example of a capacitance transducer for the present invention.
Figure 1B:
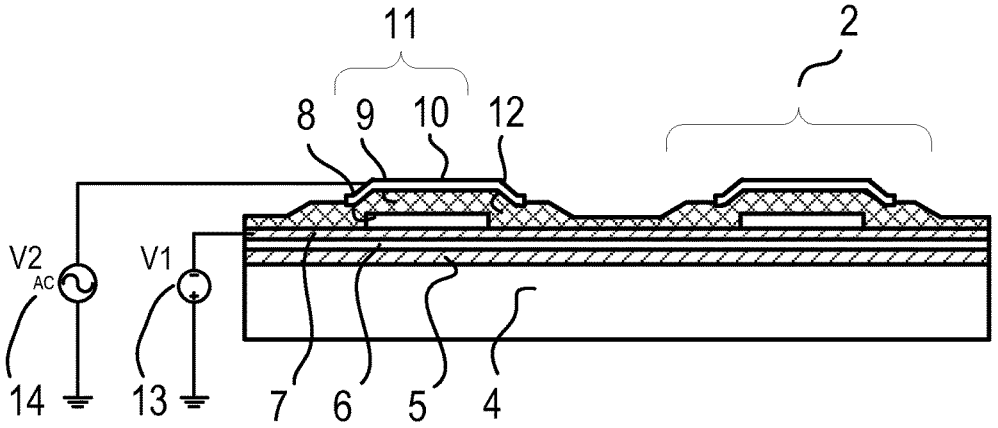
FIG. 1B is a cross-sectional view along line A-B in the top view illustrating the example of the capacitance transducer for the present invention.

An exemplary embodiment of the present invention will be described below with reference to the drawings. FIGS. 1A and 1B are diagrams illustrating an example of a capacitance transducer for the present invention: FIG. 1A is a top view; and FIG. 1B is a cross-sectional view along line A-B in FIG. 1A. In the present exemplary embodiment, a capacitance transducer 1 includes a plurality of elements 3 each including cells 2 each having a structure in which a vibration membrane including one electrode of a pair of electrodes formed with a cavity therebetween is supported in such a manner that the vibration membrane can vibrate. Although only three elements are illustrated in FIG. 1A, any number of elements may be provided. Furthermore, although each element 3 includes 44 cells 2, each element 3 may include any number of cells 2. Moreover, an arrangement of cells 2 may be any type of arrangement such as a grid-like arrangement or a staggered arrangement. Furthermore, a rough outer shape of each element 3 may be a rectangular shape such as illustrated in FIG. 1A, or, e.g., a square shape or a hexagonal shape.

As illustrated in FIG. 1B, each cell 2 includes a substrate 4, a first insulating film 5 formed on the substrate 4, a first electrode 6 formed on the first insulating film 5 and a second insulating film 7 formed on the first electrode 6. Each cell 2 further includes a vibration membrane 11 including a second electrode 10 and a membrane 9, a vibration membrane support part 12 that supports the vibration membrane 11, and a cavity 8. If the substrate 4 is an insulating substrate such as a glass substrate, the first insulating film 5 may be omitted. The cavity 8 has a circular shape as viewed from above and a vibrating part has a circular shape; however, each of such shapes may be, e.g., a square shape or a rectangular shape. Furthermore, each cell includes a voltage application unit 13 that applies a bias voltage between the first electrode 6 and the second electrode 10 of the cell 2, and a voltage application unit 14 that applies a transmission drive voltage to the second electrode 10.

The membrane 9 in the vibration membrane 11 is an insulating film. In particular, a silicon nitride film is desirable because a silicon nitride film can be formed so as to have a low tensile stress, for example a tensile stress of 300 MPa or less, enabling prevention of large deformation of the vibration membrane due to residual stress in the silicon nitride film. The membrane 9 in the vibration membrane 11 does not have to be an insulating film. For example, single-crystal silicon having a low resistance of 1 Ω·cm can be used as the membrane 9. In such case, the membrane can be used as the second electrode.

In the capacitance transducer for the present exemplary embodiment, the first voltage application unit 13 can apply a bias voltage to the first electrode 6. It is noted that the second electrode 10 is fixed at a ground potential. In the present invention, the ground potential is not necessarily 0V, and indicates a reference potential a transmission/reception circuit has. Upon application of a bias voltage to the first electrode 6, a potential difference occurs between the first electrode 6 and the second electrode 10. This potential difference displaces the vibration membrane 11 to a position at which a resilience of the vibration membrane and an electrostatic attractive force are balanced out. When acoustic waves reach the vibration membrane 11 in this state, the vibration membrane 11 vibrates and a capacitance between the first electrode 6 and the second electrode 10 thereby changes, resulting in current flowing in the second electrode 10. The current is an electric signal corresponding to a strength of the acoustic waves, and the current is output via a second electrode pad 41 connected to the second electrode 10. Furthermore, in a state in which the first voltage application unit 13 applies the bias voltage to the first electrode 6, the second voltage application unit 14 applies a transmission drive voltage to the second electrode 10 (that is, superimposes a transmission drive voltage on the bias voltage), whereby acoustic waves are transmitted. The transmission drive voltage may have any waveform if the waveform is one that enables transmission of intended acoustic waves. An arbitrary waveform such as a unipolar pulse, a bipolar pulse, a burst waveform or a continuous waveform may be used.

Description of "pull-in" will be provided herein. For example, focusing on one cell, as the voltage applied to the first electrode 6 increases, the resilience of the vibration membrane 11 and the electrostatic attractive force are balanced out and the vibration membrane 11 comes into contact with the insulating film 7 below the cavity 8. The vibration membrane 11 coming into contact with the lower side as described above is called "pull-in" and the voltage when the pull-in occurs is referred to as "pull-in voltage". As the bias voltage is higher, a distance between the first electrode 6 and the second electrode 10 becomes shorter, and thus, a conversion efficiency of conversion of received acoustic waves to an electric signal or conversion of an electric signal to acoustic waves is enhanced. However, when a bias voltage that is equal or higher than the pull-in voltage is applied between the electrodes and the vibration membrane comes into contact with a surface below the cavity, the frequency characteristics of the cell largely change and the sensitivity of reception of acoustic waves that can be received also largely changes. Furthermore, the strength and frequency characteristics of acoustic waves that can be transmitted largely change. In other words, considering an element as a unit, if elements 3 to which a voltage that is higher than the pull-in voltage has been applied and elements 3 to which the voltage that is higher than the pull-in voltage has not been applied are mixed in an element group to be driven, variation in, e.g., reception sensitivity becomes large.

In the present exemplary embodiment, in a mode in which an element group that is at least a part of the plurality of elements receives acoustic waves, a voltage that is lower than a lowest pull-in voltage of pull-in voltages of the respective elements in the element group is applied to the element group as a reception bias voltage. If attention is focused on one element, in the present specification, "an element is pulled in" means that all of cells in the element are pulled in. In other words, a voltage at which all of cells in an element are pulled in is a pull-in voltage for the element. If a plurality of elements is provided, the pull-in voltage can vary from element to element. Therefore, in the present exemplary embodiment, a reception bias voltage is set to be lower than a pull-in voltage that is the lowest in the pull-in voltages of the respective elements. Consequently, since all of elements in the element group are driven for reception in a non-pull-in state, variation in reception sensitivity of the elements can be reduced. Furthermore, in a mode in which the element group transmits acoustic waves, a voltage that is lower than the reception bias voltage is applied to the element group as a transmission bias voltage. Furthermore, in driving for transmission, the transmission bias voltage with a transmission drive voltage superimposed thereon is applied to an element group to be driven for transmission. A linear electronic scan using ultrasound waves can be performed by switching the element to be driven for transmission from one to another in time sequence. In the present exemplary embodiment, a sum of the transmission bias voltage and the transmission drive voltage can be made to be lower than the lowest pull-in voltage. It is noted that the transmission drive voltage is, for example, a maximum value of an amplitude of the waveform illustrated in FIG. 2B, which is an amplitude in a direction in which the bias voltage is increased. If elements 3 to which a voltage that is equal to or higher than the pull-in voltage has been applied and elements 3 to which the voltage that is equal to or higher than the pull-in voltage has not been applied are mixed in the elements included in the capacitance transducer 1, variation in transmission sound pressure becomes large. In the present exemplary embodiment, as described above, in driving for transmission, the element group is driven for transmission in a non-pull-in state, which can reduce variation in transmission sound pressure of the elements.

The capacitance transducer for the present exemplary embodiment can be manufactured by means of a semiconductor micro fabrication process. The thicknesses of the insulating film 7 and the membrane 9 and the height of the cavity 8 may vary because of variation in formed films at the time of manufacture. The variation at the time of manufacture results in variation in distance between the first electrode 6 and the second electrode 10. Furthermore, the thicknesses of the membrane 9 and the second electrode 10 included in the vibration membrane 11 also vary, which results in variation in spring constant of the vibration membrane 11 also vary. The variation in distance between the first electrode 6 and the second electrode 10 and/or the variation in spring constant of the vibration membrane 11 result in variation in pull-in voltage of the cells 2, and thus, variation occurs also in pull-in voltages of elements 3 each including a plurality of cells 2. When a same bias voltage is applied to an element group in a capacitance transducer 1 including a plurality of elements 3 having pull-in voltage variation occurred due to manufacturing variation, all of the elements 3 of the element group are driven in a non-pull-in state. Consequently, variation in reception sensitivity can be reduced. Furthermore, for a sum of a bias voltage and a transmission voltage, the element group is driven with all of the elements 3 not in a pull-in state, enabling reduction of variation in transmission sound pressure. In order to enhance the sensitivity of reception of acoustic waves to obtain a clear ultrasound image, a reception bias voltage can be set to be as high as possible under the above conditions.

Figure 2A:
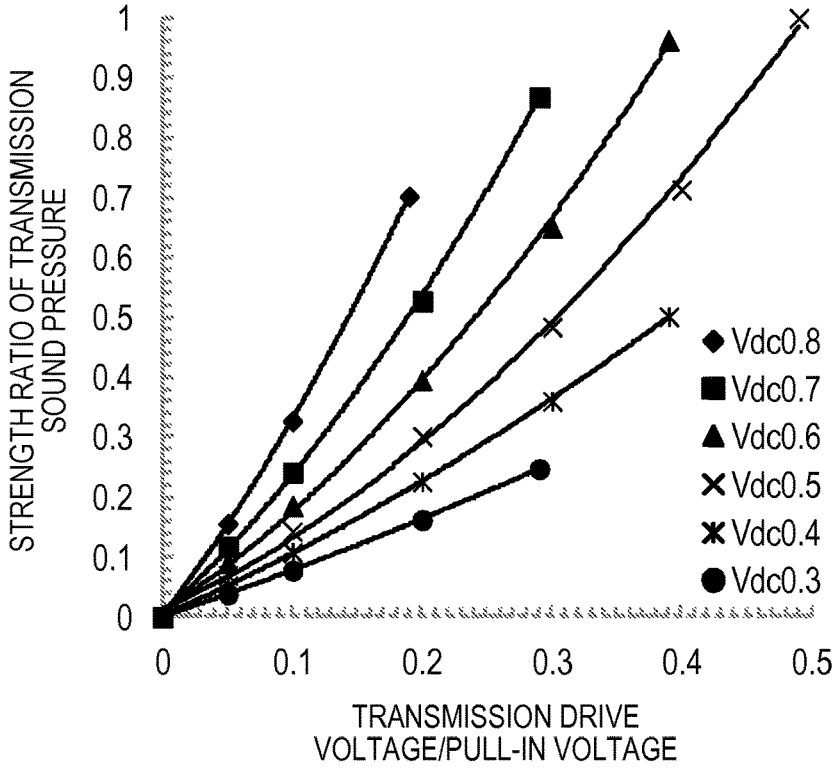
FIG. 2A is a diagram illustrating an example of transmission drive voltage-acoustic wave strength (transmission sound pressure) characteristics.

If driving is performed using a same voltage for a reception bias voltage and a transmission bias voltage, the transmission bias voltage also becomes high and thus the transmission drive voltage is limited. Therefore, the strength of acoustic waves that can be transmitted is limited. For example, where the lowest pull-in voltage is 100 V and the reception bias voltage is 80 V, if the transmission bias voltage is 80 V, the transmission drive voltage (that is, the amplitude of the absolute value thereof) is less than 20 V. As opposed to this, as in the present exemplary embodiment, if a transmission bias voltage is set to be lower than a reception bias voltage, as illustrated in FIG. 2A, the strength of acoustic waves that the capacitance transducer can transmit can be enhanced. This will be described in detail below.

FIG. 2A illustrates an example of transmission drive voltage-acoustic wave strength (transmission sound pressure) characteristics. The abscissa axis represents a ratio of transmission drive voltage to pull-in voltage, and the ordinate axis represents a strength ratio of transmission sound pressure. The series each indicate a ratio of transmission bias voltage to pull-in voltage. The strength ratio of transmission sound pressure on the ordinate axis is a value with a transmission sound pressure where a series Vdc is 0.5 (series for which a ratio Vdc of transmission bias voltage to pull-in voltage is 0.5 (indicated by "x")) and the transmission drive voltage/pull-in voltage ratio is 0.49 normalized as 1. The curve of each series is a second-order approximate curve resulting from plotted points being approximated by the method of least squares. The transmission sound pressure on the ordinate axis is a maximum value on one side amplitude of a temporal waveform of acoustic waves immediately above an element 3, the temporal waveform being one obtained when a bias voltage was applied to the first electrode 6 in the capacitance transducer and a transmission drive voltage was applied to the second electrode 10 to transmit the acoustic waves.

Figure 2B:
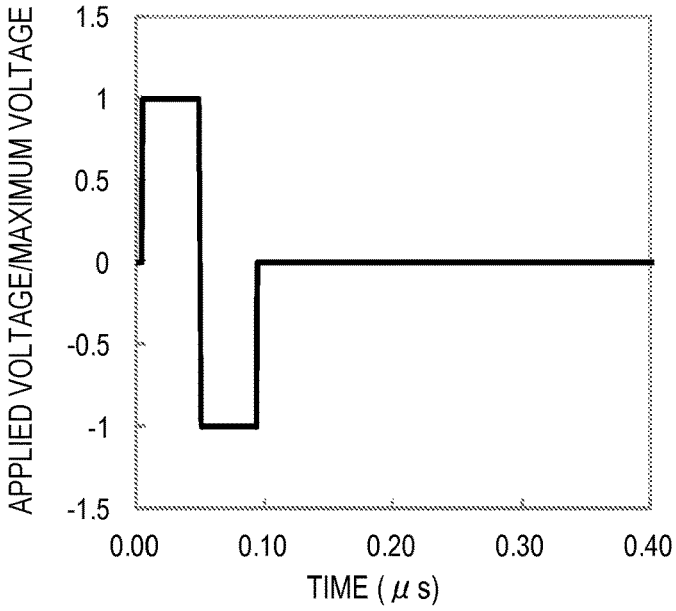
FIG. 2B is a diagram illustrating a temporal waveform of a transmission drive voltage.
Figure 3:
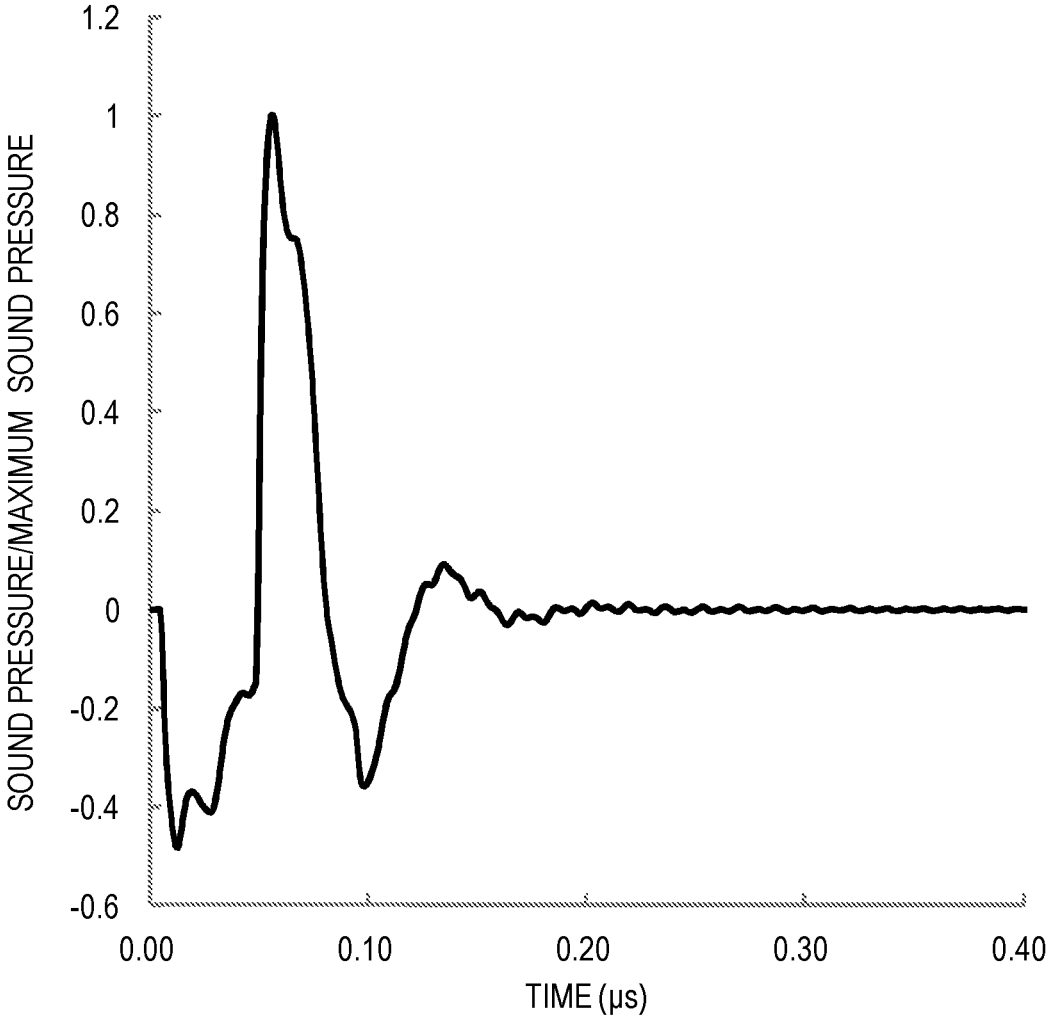
FIG. 3 is diagram illustrating an example of a temporal waveform of a sound pressure on an upper surface of an element.

FIG. 2B illustrates a temporal waveform of the transmission drive voltage and FIG. 3 illustrates a temporal waveform of sound pressure on a surface of the element 3. In both FIGS. 2B and 3, the abscissa axis represents time (μsec). The ordinate axis in FIG. 2B is a voltage ratio normalized by a maximum value, and the transmission drive voltage has a rectangular bipolar pulse waveform. A rectangular pulse width is 50 nsec. The ordinate axis in FIG. 3 is a sound pressure ratio normalized by a maximum value. The transmission drive voltage is not limited to those having a rectangular bipolar pulse waveform such as illustrated in FIG. 2B, and may have a one-side single polar pulse waveform or a burst waveform, and thus may have any waveform that enables provision of intended frequency characteristics and transmission sound pressure. FIG. 2A indicates results of calculations using combinations of a transmission bias voltage and a transmission drive voltage, a sum of which is equal to or lower than 99% of the lowest pull-in voltage. For example, where the ratio Vdc of the pull-in voltage relative to the transmission bias voltage is 0.8 (indicated by "◆") and the transmission drive voltage/pull-in voltage ratio is 0.19, the strength ratio of the transmission sound pressure is 0.7. Furthermore, if the transmission drive voltage is increased to enhance the strength of the transmission sound pressure, it is necessary to decrease the transmission bias voltage by the amount of the increase of the transmission drive voltage. For example, where the ratio of the transmission bias voltage to the pull-in voltage is 0.7 (indicated by "■") and the transmission drive voltage/pull-in voltage ratio is 0.29, the strength ratio of the transmission sound pressure is 0.86. In order to obtain a transmission sound pressure with a highest strength, for example, driving is performed with the ratio of the transmission bias voltage to the pull-in voltage set to 0.5 (indicated by "x") and the transmission drive voltage/pull-in voltage ratio set to 0.49, the strength ratio of the transmission sound pressure becomes 1. Where driving is performed when a sum of the transmission bias voltage and the transmission drive voltage is equal to or lower than 99% of the lowest pull-in voltage, in order to obtain a maximum transmission sound pressure, driving is performed with the transmission drive voltage/pull-in voltage ratio increased by a range of less than 0.5, and a further enhanced strength of the transmission sound pressure can be obtained.

For example, transmission driving is performed with the ratio of the reception bias voltage to the pull-in voltage set to 0.8 and the transmission bias voltage and the reception bias voltage set to be the same (indicated by "◆"). In this case, a maximum ratio of the transmission drive voltage is 0.19 and the strength ratio of the transmission sound pressure obtained under this condition is only 0.7 at a maximum. On the other hand, as in the present exemplary embodiment, the ratio of the reception bias voltage to the pull-in voltage is set to 0.8 and the ratio of transmission bias voltage is set to 0.5 (that is, is set to be lower than the reception bias voltage). Then, as indicated by the series indicated by the "x"s, the maximum ratio of the transmission drive voltage is 0.49 and the strength ratio of the resulting transmission sound pressure is 1.0. If the ratio of the transmission bias voltage is 0.7 (in this case, also, is lower than the reception bias voltage), as indicated by the series indicated by the "■"s, the maximum ratio of the transmission drive voltage is 0.29 and the strength of the resulting transmission sound pressure is 0.86. Thus, a transmission sound pressure that is higher than a transmission sound pressure when driving is performed with transmission and reception bias voltages set to be the same can be obtained.

In other words, setting a transmission bias voltage to be lower than a reception bias voltage and setting a transmission drive voltage to be lower than a difference between a pull-in voltage and the transmission bias voltage enable transmission of a sound pressure that is equivalent to or higher than a sound pressure when driving is performed with transmission and reception bias voltages are set to the same. Although the above description has been provided assuming that the ratio of the reception bias voltage to the pull-in voltage is 0.8, the ratio may be a value that is other than 0.8, but lower than 1.

Furthermore, where driving is performed with the transmission bias voltage set within a range that is lower than the reception bias voltage, it is preferable that the transmission bias voltage be lower in obtaining a same transmission sound pressure strength. For example, for obtaining a transmission sound pressure strength ratio of 0.6, the transmission bias voltage is set to 0.8 of the lowest pull-in voltage (indicated by "◆") and the transmission drive voltage/pull-in voltage ratio is set to 0.165, whereby the strength ratio of 0.6 is obtained. Likewise, the transmission bias voltage is set to be 0.5 of the lowest pull-in voltage (indicated by "x") and the transmission drive voltage/pull-in voltage ratio is set to 0.345, whereby the strength ratio of 0.6 is obtained. However, comparing the slopes of the tangents at the points at which a same strength ratio is obtained, the slope of the tangent is lower as the transmission bias voltage is lower. This indicates that as the slope is lower, variation in transmission sound pressure strength ratio, which occurs when variation in applied voltage occurs, is lower, and thus, driving can be performed under the driving condition that the slope is low.

The variation in applied voltage means that variation occurs in effective electric field strength of a bias voltage applied to the first electrodes 6. In other words, a case where a pull-in voltage varies depending on each of the elements 3 included in the capacitance transducer 1 will be considered. In this case, since the elements 3 shares the common first electrode 6, upon application of a common bias voltage to the first electrode 6, variation occurs in the bias voltage effectively applied to the respective elements 3. Furthermore, upon application of a common transmission drive voltage to the second electrodes 10, variation occurs in the transmission drive voltage effectively applied to the respective elements 3. As the transmission bias voltage is higher, the effect of difference between the effectively-applied bias voltage and the transmission drive voltage on the variation in strength of the transmission sound pressure becomes larger, and thus, as in the present exemplary embodiment, driving can be performed under a driving condition that reduces variation in strength of the transmission sound pressure. As is clear from FIG. 2A, driving can be performed with a range of a transmission bias voltage that is no more than one half of a lowest pull-in voltage.

Setting a transmission drive voltage to be lower than a transmission bias voltage enables the vibration membrane 11 to vibrate normally. In a capacitance transducer, if an amplitude of a transmission drive voltage is increased to be equal to or higher than a transmission bias voltage, the vibration membrane 11 may fail to normally vibrate. Normal vibration of the vibration membrane 11 means that the vibration membrane 11 vibrates so as not to run over a position of the vibration membrane 11 in an initial state in which no bias voltage is applied, in a direction opposite to a direction in which the position of the vibration membrane 11 changes upon application of a bias voltage. If the transmission drive voltage is equal to or exceeds the transmission bias voltage, the frequency characteristics the elements 3 have largely change. Accordingly, the variation in strength of the transmission sound pressure becomes larger, which makes it impossible to obtain an intended strength ratio of the transmission sound pressure, and thus, the transmission drive voltage can be set to be lower than the transmission bias voltage.

For example, in order to obtain a transmission sound pressure strength ratio of 0.2, the transmission bias voltage can be set to be 0.3 times the lowest pull-in voltage (indicated by "●" in FIG. 2A) and the transmission drive voltage/pull-in voltage ratio can be set to be 0.24. A combination of the transmission bias voltage and the transmission drive voltage can be set so as to meet the conditions that: an intended transmission sound pressure strength ratio is obtained; the vibration membrane 11 normally vibrates; and a slope of an approximate curve including a point at which a strength of an intended transmission sound pressure can be obtained is small.

Figure 4A:
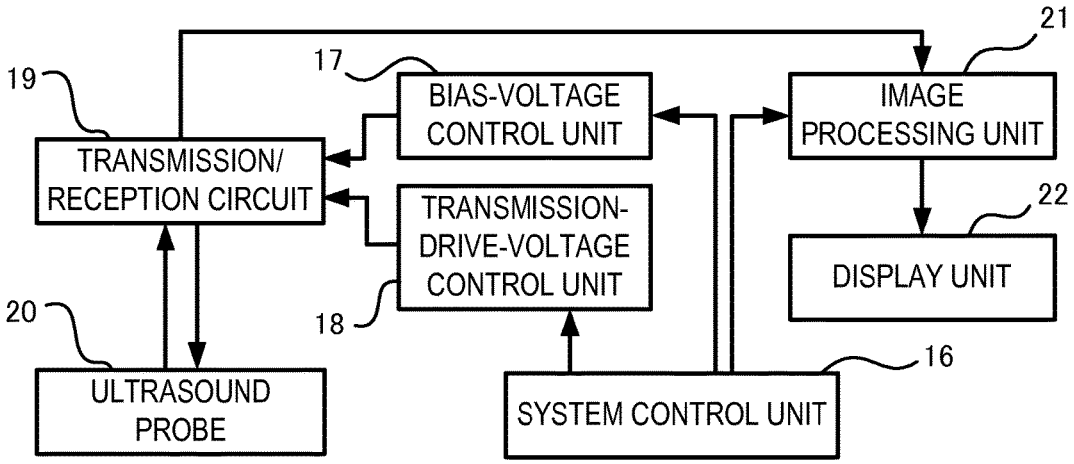
FIG. 4A is a diagram illustrating an example of a device for driving the capacitance transducer.

Next, FIG. 4A illustrates an example of a drive device. An apparatus such as an ultrasound diagnostic apparatus includes, e.g., a system control unit 16, a bias voltage control unit 17, a transmission drive voltage control unit 18, a transmission/reception circuit 19, an ultrasound probe 20, an image processing unit 21 and a display unit 22. A drive device includes, e.g., the bias voltage control unit 17 and the transmission drive voltage control unit 18. The ultrasound probe 20 is a transmission/reception probe including a capacitance transducer 1 that transmits acoustic waves to a test object and receives the acoustic waves reflected from the test object. The transmission/reception circuit 19 is a circuit that supplies a bias voltage and a drive voltage, which are externally supplied, to the ultrasound probe 20, or processes acoustic waves received by the ultrasound probe 20 and outputs the resultant of the processing to the image processing unit 21. The bias voltage control unit 17 supplies a bias voltage to the transmission/reception circuit 19 in order to supply the bias voltage to the ultrasound probe 20. The bias voltage control unit 17 includes a power supply and a switch, which are not illustrated, and switches between a transmission bias voltage and a reception bias voltage at timings designated by the system control unit 16 and supplies the relevant bias voltage to the transmission/reception circuit 19. The transmission drive voltage control unit 18 supplies a transmission drive voltage to the transmission/reception circuit 19 in order to supply the transmission drive voltage to the ultrasound probe 20. At a timing designated by the system control unit 16, a waveform that provides intended frequency characteristics and transmission sound pressure strength is supplied to the transmission/reception circuit 19. The image processing unit 21 performs image conversion (for example, that for a B-mode image or an M-mode image) using signals output from the transmission/reception circuit 19 and outputs the resulting image signals to the display unit 22. The display unit 22 is a display apparatus that displays image signals output from the image processing unit 21. The image display unit 22 can be separated from the drive device, etc. The system control unit 16 is a circuit that controls, e.g., the bias voltage control unit 17, the transmission drive voltage 18 and the image processing unit 21.

Figure 4B:
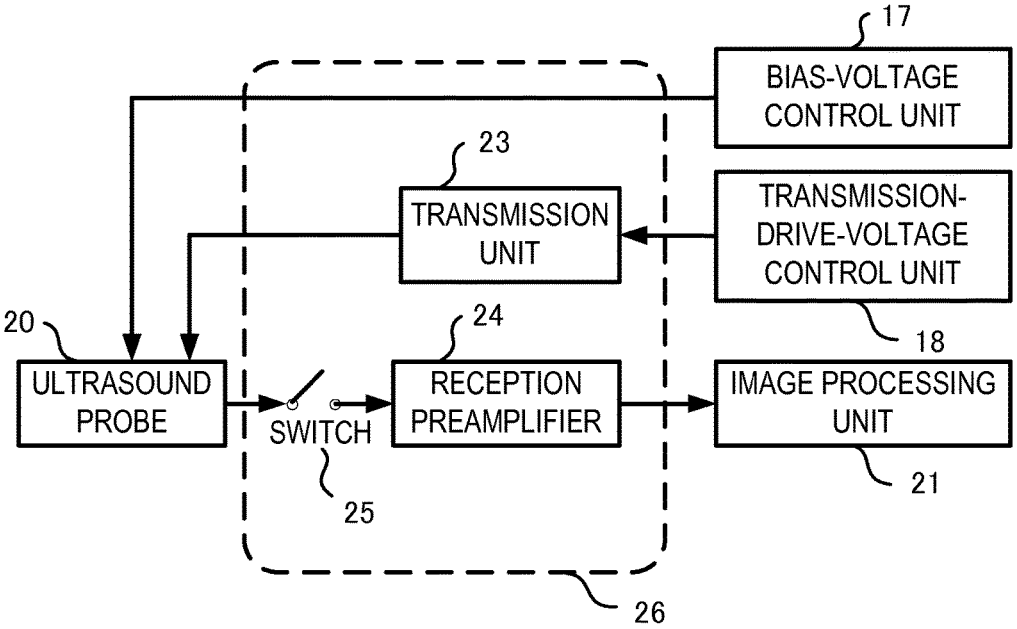
FIG. 4B is a diagram illustrating an example of a transmission/reception circuit.

FIG. 4B illustrates an example transmission/reception circuit. A transmission/reception circuit 26 includes a transmission unit 23, a reception pre-amplifier 24 and a switch unit 25. In driving for transmission, the transmission/reception circuit 26 applies a bias voltage applied from the bias voltage control unit 17 according to a transmission bias voltage designated by the system control unit 16 in the FIG. 4A, to the ultrasound probe 20. Likewise, the transmission/reception circuit 26 applies a voltage applied from the transmission drive voltage control unit 18 according to a transmission drive voltage designated by the system control unit 16, to the ultrasound probe 20 via the transmission unit 23. Upon application of the transmission drive voltage, the switch unit 25 is opened, whereby no signal flows in the reception pre-amplifier 24. When no transmission drive voltage is applied, the switch unit 25 is closed and thus provides a reception mode. The switch unit 25 includes, e.g., a non-illustrated diode, and functions as a protection circuit that prevents breakage of the reception pre-amplifier 24. Upon return of acoustic waves transmitted from the ultrasound probe 20 and reflected by a test object to the ultrasound probe 20, the ultrasound probe 20 receives the acoustic waves. In driving for reception, the transmission/reception circuit 26 applies a bias voltage applied from the bias voltage control unit 17 according to a reception bias voltage designated by the system control unit 16 in FIG. 4A, to the ultrasound probe 20. Since the switch unit 25 is closed, the reception signals are amplified by the reception pre-amplifier 24 and sent to the image processing unit 21.

Figure 5:
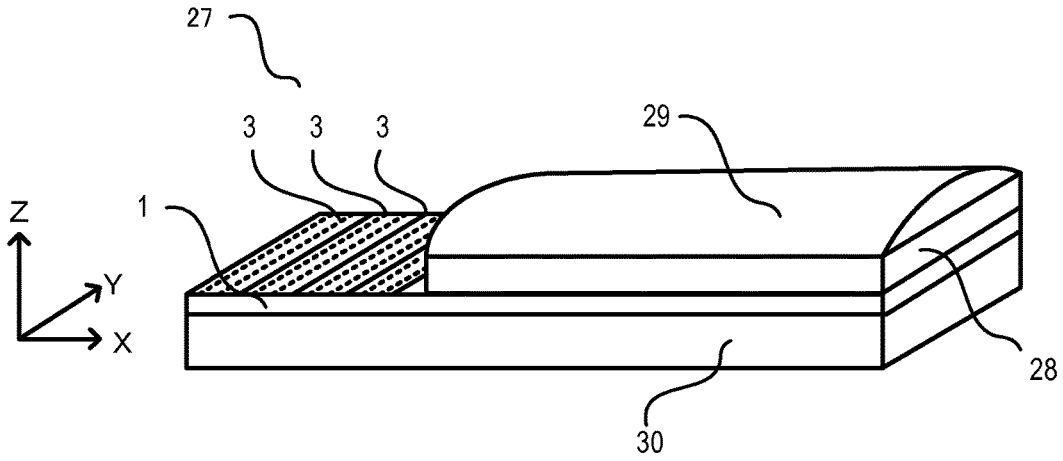
FIG. 5 is a perspective view of an ultrasound probe.

FIG. 5 illustrates an example ultrasound probe, which is a test object information obtaining apparatus. FIG. 5 is a perspective view of an ultrasound probe. An ultrasound probe 27 includes a capacitance transducer 1, an acoustic matching layer 28, an acoustic lens 29 and a circuit board 30. The capacitance transducer 1 in FIG. 5 has a configuration that is similar to that of the capacitance transducer 1 in FIGS. 1A and 1B, and as illustrated in FIG. 5, numerous elements 3 are arranged in an X direction in a one-dimensional array. Although FIG. 5 illustrates a one-dimensional array, the elements 3 may be arranged in a two-dimensional array or may be arranged so as to form another shape such as a convex shape. The capacitance transducer 1 is mounted on, and electrically connected to, a circuit board 30. The circuit board 30 may be a substrate integrated with the transmission/reception circuit 19 illustrated in FIG. 4A or the capacitance transducer 1 may be connected to the transmission/reception circuit 19 illustrated in FIG. 4A via the circuit board 30. On a front side of the capacitance transducer 1 from which acoustic waves are transmitted, an acoustic matching layer 28 is provided for acoustic impedance matching with a test object. The acoustic matching layer 28 may be provided also as a protection film for preventing electric leakage to the test object. An acoustic lens 29 is disposed via the acoustic matching layer 28. For acoustic lens 29, one that can match an acoustic impedance of the test object and that of the acoustic matching layer 28 can be used. The provision of the acoustic lens 29 having a curvature in a Y direction such as that in FIG. 5 enables acoustic waves spreading in the Y direction to be collected at a focal position of the acoustic lens. Acoustic waves spreading in the X direction cannot directly be collected, and thus, transmission driving is performed by means of beamforming with the acoustic wave transmission timing shifted from element 3 to element 3 (from element group to element group), enabling collection of the acoustic waves at the focal position. The acoustic lens 29 can have a shape that enables provision of intended acoustic wave distribution characteristics. Furthermore, depending on the type of the test object to be used, types and/or shapes of the acoustic matching layer 28 and the acoustic lens 29 may be selected or neither of the acoustic matching layer 28 and the acoustic lens 29 may be provided. A bias voltage and a transmission drive voltage to be supplied to the ultrasound probe 27 and reception signals containing information on a test object obtained by reception of acoustic waves reflected from the test object are delivered to the transmission/reception circuit 19 or the image processing unit 21 via non-illustrated cables.

Figure 6A:
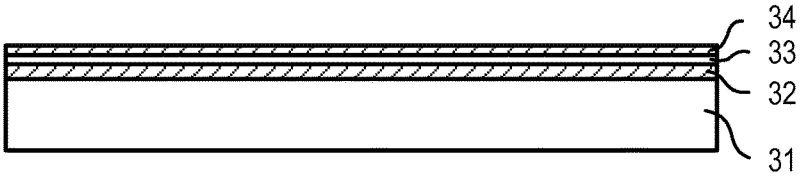
FIG. 6A is a cross-sectional view illustrating an example of a method for manufacturing the capacitance transducer for the present invention.

An example of a method for manufacturing the capacitance transducer for the present exemplary embodiment will be described with reference to FIGS. 6A to 6E. FIGS. 6A to 6E are cross-sectional views along line A-B in FIG. 1A. As illustrated in FIG. 6A, a first insulating film 32 is formed on a substrate 31. The substrate 31 is a silicon substrate, and the first insulating film 32 is intended to provide insulation from a first electrode. If the substrate 31 is an insulating substrate such as a glass substrate, it is not necessary to form the first insulating film 32. Furthermore, for the substrate 31, a substrate whose surface roughness is low is desirable. If the surface roughness is high, the surface roughness is transferred even in film forming steps after the present step and the surface roughness causes variation in distance between the first electrode and a second electrode of respective cells. The variation causes variation in conversion efficiency, resulting in variation in sensitivity and band. Therefore, it is desirable that the substrate 31 be a substrate whose surface roughness is low. Then, first electrode 33 is formed. For the first electrode 33, it is desirable to use a conductive material whose surface roughness is low, for example, titanium or aluminum. As with the substrate, if the surface roughness of the first electrode is high, the distance between the first electrode and the second electrode varies depending on the respective cells and/or the respective elements because of the surface roughness, and thus, a conductive material whose surface roughness is low is desirable.

Next, a second insulating film 34 is formed. For the second insulating film 34, an insulating material whose surface roughness is low is desirable, and the second insulating film 34 is formed to prevent an electric short or insulation breakdown between the first electrode and the second electrode when a voltage is applied between the first electrode and the second electrode. If driving is performed with a low voltage, it is not necessary to form the second insulating film 34 since a later-described membrane is an insulating body. Furthermore, the second insulating film 34 is formed to prevent etching of the first electrode in sacrifice layer removal performed in a step subsequent to the present step. It is not necessary to form the second insulating film 34 if the first electrode is not etched by an etchant or an etching gas in sacrifice layer removal. As with the substrate, if the surface roughness of the second insulating film 34 is high, the surface roughness causes variation in distance between the first electrode and the second electrode of the respective cells, and thus an insulating film whose surface roughness is low is desirable. For example, a silicon nitride film or a silicon oxide film can be used.

Figure 6B:
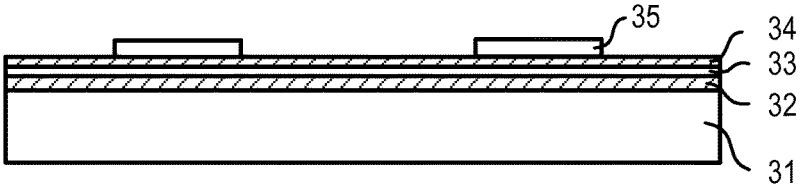
FIG. 6B is a cross-sectional view illustrating the example of the method for manufacturing the capacitance transducer for the present invention.

Next, as illustrated in FIG. 6B, a sacrifice layer 35 is formed. For the sacrifice layer 35, a material whose surface roughness is low is desirable. As with the substrate, if the surface roughness of the sacrifice layer is high, the surface roughness causes variation in distance between the first electrode and the second electrode in the respective cells, and thus, a sacrifice layer whose surface roughness is low is desirable. Furthermore, in order to reduce etching time for moving the sacrifice layer, a material that provides a high etching rate is desirable. Moreover, it is necessary to employ a sacrifice layer material that substantially prevents the insulating film and the membrane from being etched by an etchant or an etching gas for removing the sacrifice layer. If the insulating film and the membrane are etched by the etchant or the etching gas for removing the sacrifice layer, variation in thickness of a vibration membrane and variation in distance between the first electrode and the second electrode occur. The variation in thickness of the vibration membrane and variation in distance between the first electrode and the second electrode result in variation in sensitivity and band of the respective cells. If each of the insulating film and the membrane is a silicon nitride film or a silicon oxide film, a sacrifice layer material whose surface roughness is low, the sacrifice layer material enabling use of an etchant or an etching gas that hardly etches the insulating film and the membrane, is desirable. For example, amorphous silicon, polyimide or chrome may be used. In particular, a chrome etchant does not substantially etch a silicon nitride film or a silicon oxide film, and thus, is desirable where each of the insulating film and the membrane is a silicon nitride film or a silicon oxide film.

Figure 6C:
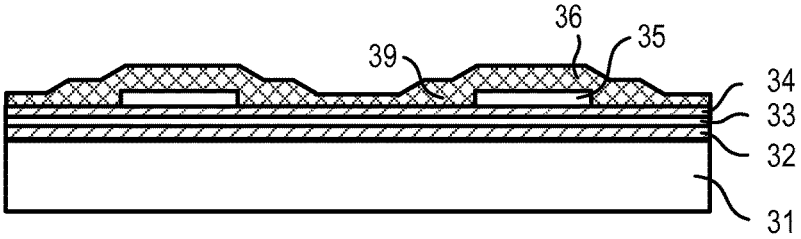
FIG. 6C is a cross-sectional view illustrating the example of the method for manufacturing the capacitance transducer for the present invention.

Next, as illustrated in FIG. 6C, a membrane 36 is formed. The membrane 36 desirably has a low tensile stress, for example, a tensile stress of 500 MPa or less. A silicon nitride film can be subjected to stress control and can be made to have a low tensile stress of 500 MPa or less. If the membrane has compressive stress, the membrane causes sticking or buckling and thereby largely deforms. Furthermore, if the membrane 36 has a high tensile stress, the membrane may be destroyed. Accordingly, the membrane 36 desirably has a low tensile stress. For example, a silicon nitride film that can be subjected to stress control to have a low tensile stress can be used.

Next, non-illustrated etching holes are formed, the sacrifice layer 35 is removed via the etching holes and then the etching holes are sealed. For example, the etching holes can be sealed by a silicon nitride film or a silicon oxide film. The sacrifice layer removal step or the sealing step can be performed after formation of the second electrode.

Figure 6D:
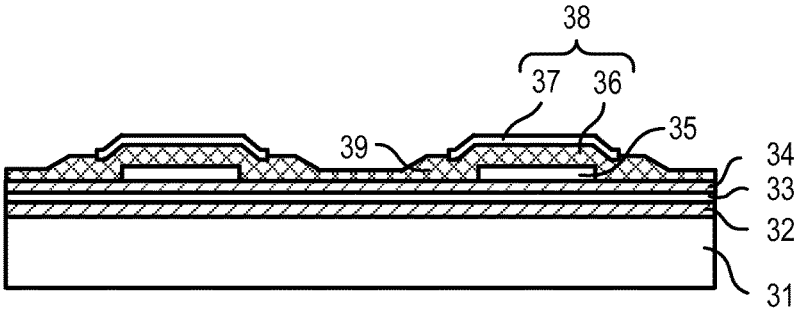
FIG. 6D is a cross-sectional view illustrating the example of the method for manufacturing the capacitance transducer for the present invention.
Figure 6E:
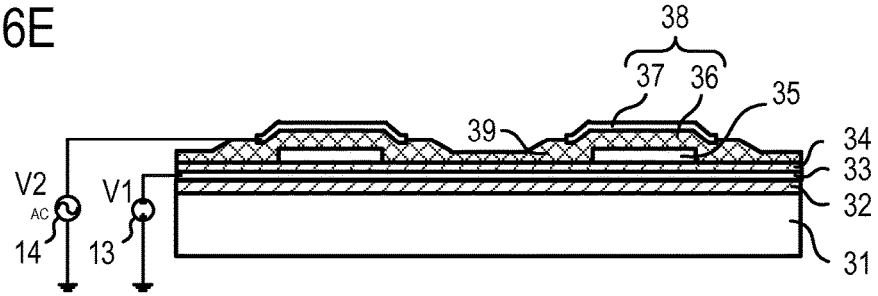
FIG. 6E is a cross-sectional view illustrating the example of the method for manufacturing the capacitance transducer for the present invention.

Next, as illustrated in FIG. 6D, second electrodes 37 are formed. For the second electrodes 37, a material whose residual stress is low is desirable, and, e.g., aluminum may be used. If the second electrodes are formed before the sacrifice layer removal step or the sealing step, a material having an etching resistance to sacrifice layer etching and heat resistance is desirable for the second electrode. For example, titanium can be used. In FIG. 6D, the second electrodes 37 are electrically separated from one another, but may be electrically connected to one another. FIG. 6E illustrates a state in which a voltage application unit 13 and a voltage application unit 14 are connected to the first electrode 33 and the second electrode 37, respectively. Here, in FIG. 6E, the sacrifice layer 35 is illustrated, but is eventually removed, whereby a cavity is formed in the respective positions.

Here, in the present exemplary embodiment, a lowest pull-in voltage of the elements 3 included in the capacitance transducer 1 may be obtained by actually measuring pull-in voltages of the elements 3 when transmitting and receiving acoustic waves or measuring pull-in voltages of pull-in voltage measurement elements (TEG) disposed around the capacitance transducer. However, if the pull-in voltages of the elements when transmitting and receiving acoustic waves are measured, the insulating films in the elements are electrically charged, causing variation in characteristics, and measurement using the pull-in voltages of the TEGs can be employed. A pull-in voltage can be measured by measuring a capacity when a bias voltage is changed. As the bias voltage is increased, the capacity also increases, and the capacity stops changing at a certain voltage. This voltage is a pull-in voltage. Furthermore, a pull-in voltage can be measured by measuring a change in resonant frequency when a bias voltage is changed. As the bias voltage is increased, the resonant frequency is lowered and the resonant frequency makes a shift to a high frequency at a certain voltage. This voltage is a pull-in voltage. A pull-in voltage only has to be measured by a method that ensures an intended accuracy and any measurement technique may be employed.

Furthermore, in the manufacturing process described above, a pull-in voltage can be estimated by means of calculation, by measuring thicknesses and/or permittivities of the respective films formed and a diameter of the relevant cell. A pull-in voltage can be calculated by calculating a relationship between a capacitance and a vibration membrane displacement by means of, e.g., the finite element method to provide the capacitance as a polynomial approximation of the displacement and to solve first and second-order partial derivatives of the polynomial approximation. A film thickness can be measured using, e.g., optical interferometry or a stylus-type surface shape measuring device. For calculation of a permittivity, a film is formed between upper and lower electrodes and a capacity between the electrodes is measured, and then the permittivity is calculated from the capacity, the areas of the electrodes, a distance between the upper and lower electrodes and a permittivity of vacuum. A diameter of a cell can be optically measured using, e.g., a microscope. A film thickness measuring element for measuring a film thickness can be disposed in the vicinity of an element for transmitting and receiving acoustic waves, in order to estimate characteristics of the element by means of calculation. A needed number of film thickness measuring elements may be provided at desired positions in order to grasp firm formation variation in a film forming apparatus used for a semiconductor micro fabrication process using, e.g., a silicon substrate.

A lowest pull-in voltage of the elements 3 can be estimated by a combination of the measurements and calculations described above. For example, a case where 50 elements 3 included in a capacitance transducer 1 are arranged in a one-dimensional array will be described. A film thickness measuring element is provided for each element 3, and a film thickness and a permittivity of each film and a diameter of each cell are measured in a manufacturing process. Based on the measurement data, a pull-in voltage of each element 3 is calculated by means of the finite element method. Furthermore, pull-in voltages of elements 3 disposed at opposite ends of the one-dimensional array are measured. A difference between the measured value and the calculated value of each of the elements 3 at the opposite ends is taken into account in correction of calculated values of the remaining elements, enabling estimation of the pull-in voltages with good accuracy. The number of elements to be measured may be one, or it is possible to measure a plurality of elements and correct the calculated values using an average value of differences between the measured values and the calculated values as a correction factor. Moreover, it is possible that a plurality of TEGs is provided in the vicinity of the elements 3 included in the capacitance transducer 1 and values of measurement of pull-in voltages of the TEGs are used as measured values, and it is also possible that a number of TEGs, the number being the same as the number of elements 3, are provided to measure pull-in voltages of the elements 3. Each of the above-described methods enables obtainment of a lowest pull-in voltage of pull-in voltages of respective elements 3 in an element group; however, another technique may be employed for pull-in voltage estimation or measurement. The lowest pull-in voltage is obtained, for example, at the time of manufacture, and based on the lowest pull-in voltage, e.g., a reception bias voltage and a transmission bias voltage are set for the elements in the drive device.

In the capacitance transducer for the present exemplary embodiment, electric signals can be extracted from the second electrodes 37 using non-illustrated lead wirings electrically connected to the second electrode pads 41 in FIG. 1A. When ultrasound waves are received by the capacitance transducer, a direct-current voltage is applied to the first electrodes 33 in advance. Upon reception of ultrasound waves, the vibration membranes 38 including the second electrodes 37 deform, whereby distances of a cavity between the second electrodes 37 and the first electrodes 33 change and the respective capacitances change. The capacitance change causes current flow in the respective lead wirings. This current is subjected to current-voltage conversion by the transmission/reception circuit 26 illustrated in FIG. 4B, whereby ultrasound waves can be received in the form of a voltage. Furthermore, a direct-current voltage is applied to the first electrodes 33 and a transmission drive voltage is applied to the second electrodes 37, whereby the vibration membranes 38 can be made to vibrate by an electrostatic force. Consequently, ultrasound waves can be transmitted.

Driving a capacitance transducer manufactured as described above by means of the driving method according to the present exemplary embodiment provides the following effects. Namely, variation in strength of acoustic waves transmitted from driven elements in one capacitance transducer, which would occur where the elements are driven using transmission and reception bias voltages that are equal to each other, can be reduced. Consequently, variation of reflected waves from a test object is reduced and distortion of an ultrasound image based on reception signals is reduced, resulting in enhancement in resolution.

Example 1

Figure 7A:
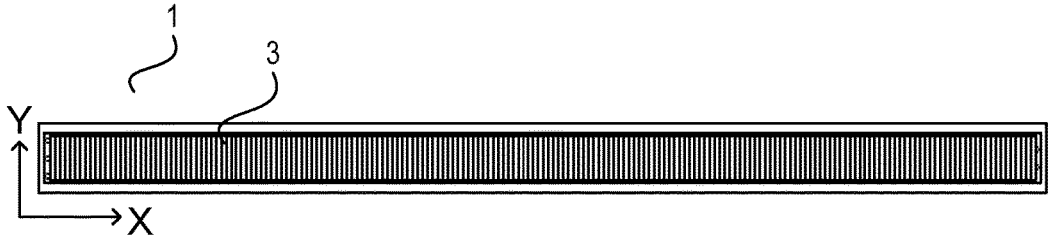
FIG. 7A is a top view of a capacitance transducer in Example 1.
Figure 7B:
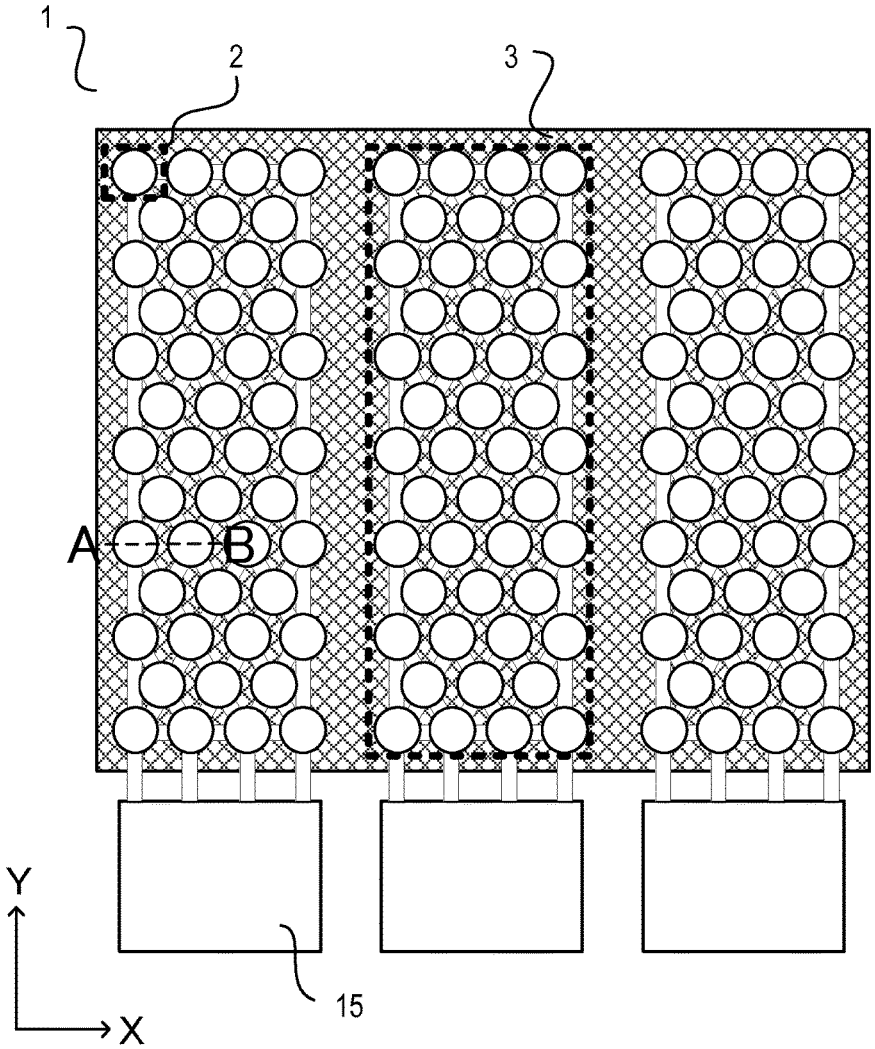
FIG. 7B is an enlarged schematic diagram of FIG. 7A.
Figure 8A:
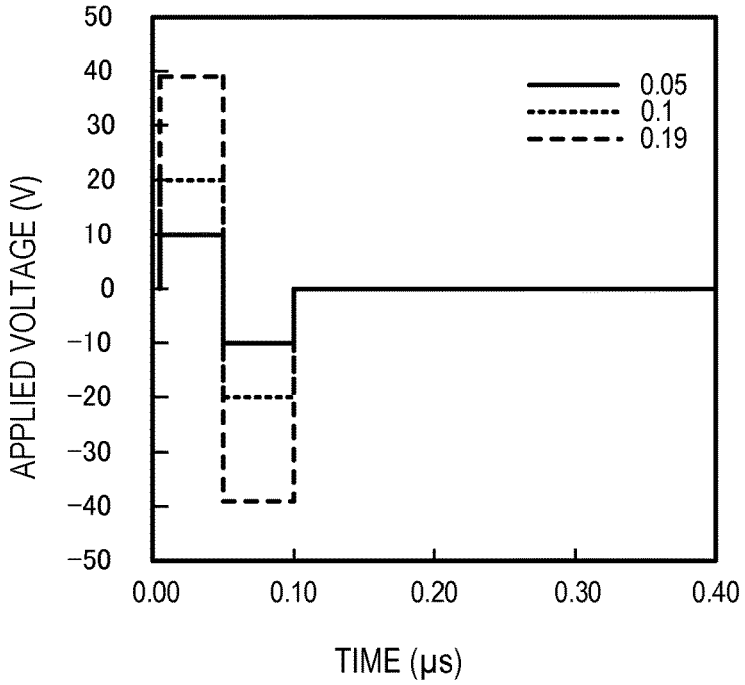
FIG. 8A is a diagram illustrating an example of a temporal waveform of a transmission drive voltage for describing Example 1.

An example of the present invention will be described below with reference to FIGS. 7A to 8B. FIGS. 7A and 7B are top views of a capacitance transducer for the present example, and FIG. 7B is an enlarged schematic view of FIG. 7A. FIG. 8A illustrates a temporal waveform of a transmission drive voltage applied to elements in the capacitance transducer for the present example.

External dimensions of a capacitance transducer 1 illustrated in FIG. 7A are 7.5 mm in a Y direction and 44 mm in an X direction. An outer shape of each element 3 is 0.2 mm in the X direction and 4 mm in the Y direction, and 196 elements 3 are arranged in a one-dimensional array. FIG. 7B is a schematic view of an enlargement of a part of FIG. 7A, and a cross-sectional view along line A-B in FIG. 7B is FIG. 6D. Cells 2 included in each element 3 each have a circular shape, and each cavity 8 has a diameter of 31 μm. The cells 2 are arranged in a closest-packed manner as illustrated in FIG. 7B, and cells 2 included in one element 3 are arranged with a space of 34 μm from respective adjacent cells. In other words, a shortest distance between cavities 8 of adjacent cells 2 is 3 μm. Although an abbreviated number of cells are illustrated in FIG. 7B, in reality, 702 cells 2 are arranged in one element 3.

Each cell 2 includes a silicon substrate 4 having a thickness of 300 μm, a first insulating film 5 formed on the silicon substrate 4, a first electrode 6 formed on the first insulating film 5, and a second insulating film 7 formed on the first electrode 6. Furthermore, each cell 2 includes a vibration membrane 11 including a second electrode 10 and a membrane 9, a vibration membrane support part 12 supporting the vibration membrane 11, and a cavity 8. The cavity 8 has a height of 240 nm. Each cell 2 further includes a voltage application unit 13 that applies a bias voltage between the first electrode and the second electrode and a voltage application unit 14 that applies a transmission drive voltage to the second electrode. The first insulating film 5 is a silicon oxide film having a thickness of 1 μm, which is formed by means of thermal oxidation. The second insulating film 7 is a silicon oxide film having a thickness of 100 nm, which is formed by means of PE-CVD. The first electrode 6 includes titanium having a thickness of 50 nm and the second electrode 10 is aluminum having a thickness of 100 nm. The membrane 9 is a silicon nitride film produced by means of PE-CVD so as to have a tensile stress of 450 MPa or less and a thickness of 1400 nm.

Pull-in voltage measurement elements (TEG) are arranged in the periphery of the capacitance transducer described above. Pull-in voltages of the TEGs arranged close to elements at opposite ends of, and an element in a center of, the capacitance transducer are 203V, 207V and 216V in order from the left end. Furthermore, in order to measure a film thickness of each of films formed in the above-described manufacturing process, where the element 3 at the left end is a first element and the element 3 at the right end is a 196th element, film thickness measuring elements are arranged at five positions spaced from one another by 8 mm from the vicinity of the first element to the vicinity of the 196th element. For measurement of the diameters of the cavities 8, the cavities 8 at ten positions in each of elements with a film thickness measuring element arranged in the vicinity thereof are measured. An average of the measured diameters of the cavities 8 at the ten positions in each element is regarded as the diameter of the cavities 8. There is no difference in diameter among the cavities 8: the cavities 8 have a diameter of 31 μm. If pull-in voltages are calculated by the finite element method based on the results of measurement of the diameter of the cavities 8 and the results of film thickness measurement of each film, the pull-in voltages are 226V, 224V, 230V, 236V and 240V in order from the film thickness measurement element in the vicinity of the first element. Differences between calculated values and measured values are approximately 10%, and a lowest pull-in voltage is estimated based on a tendency of the pull-in voltages calculated from the film thickness measurement results. Then, it can be estimated that an element whose pull-in voltage calculated from the film thickness measurement results is 224V is an element having a lowest pull-in voltage and an actual pull-in voltage of that element is approximately 201V. It can be estimated that the pull-in voltages of the elements 3 included in the capacitance transducer 1 for the present example can be estimated vary from 201V to 216V. The lowest value of the pull-in voltage, which is 224V where calculated from the film thickness measurement results, is 201V (which is exactly 201.6V and thus the fractional portion of the number has been dropped) in consideration of the difference of −10% between the calculated values and the measured values. Furthermore, a highest value of a pull-in voltage, which is 240V where calculated from the film thickness measurement results, is 216V in consideration of the difference of −10% between the calculated values and the measured values.

Next, an acoustic matching layer having a thickness of 25 μm is formed on the capacitance transducer 1. In the present example, a silicone adhesive having an acoustic impedance of 1.082 MRayls and an attenuation coefficient of $1.47\times F^{1.44}$ dB/cm/MHz (F is a frequency) is used. Furthermore, an acoustic lens having an acoustic impedance of 1.22 MRayls, an attenuation coefficient of $3.1\times F^{1.4}$ dB/cm/MHz and an average thickness of 530 μm is formed on the acoustic matching layer.

Figure 8B:
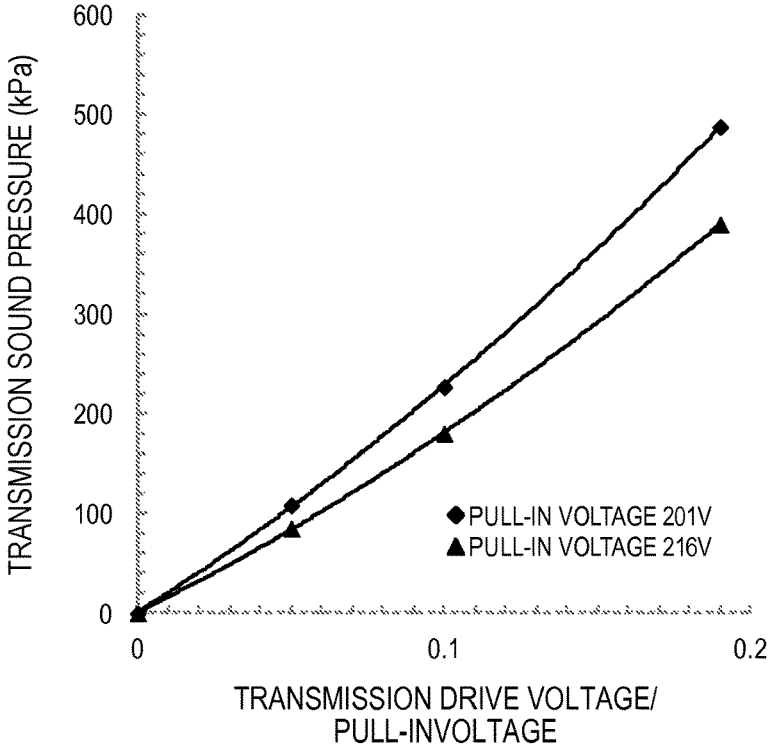
FIG. 8B is a diagram illustrating an example of transmission drive voltage-acoustic wave strength (transmission sound pressure) characteristics for describing Example 1.

Next, transmission driving is performed using the fabricated capacitance transducer. First, a case where a reception bias voltage and a transmission bias voltage are equal to each other will be described as a comparative example. A reception bias voltage and a transmission bias voltage are obtained as 80% of a lowest pull-in voltage, and the obtained bias voltage of 160V is applied to the first electrode 6. A transmission drive voltage is applied to the second electrode 10 with a ratio of the transmission drive voltage to the lowest pull-in voltage set to 0.05, 0.1 and 0.19. FIG. 8A illustrates temporal waveforms of the respective transmission drive voltages. In FIG. 8A, the abscissa axis represents time (μs) and the ordinate axis represents transmission drive voltage (V). The series indicate respective cases where the ratio of the transmission drive voltage to the lowest pull-in voltage is 0.05 to 0.19. The waveform of each transmission drive voltage is a bipolar waveform having a pulse width of 45 ns such as illustrated in FIG. 8A, and an absolute value of each of amplitudes of the positive side and the negative side of the waveform is a transmission drive voltage. FIG. 8B illustrates transmission sound pressure characteristics in this case. The curves in FIG. 8B are second-order polynomial approximate curves of plots in transmission under the respective conditions. In FIG. 8B, the abscissa axis represents the ratio of transmission drive voltage to lowest pull-in voltage. The ordinate axis represents transmission sound pressure transmitted by one element of the elements 3 included in the capacitance transducer 1 upon application of a transmission drive voltage thereto, which is transmission sound pressure after passage of the acoustic matching layer and the acoustic lens. FIG. 8B illustrates the transmission sound pressure of an element having a lowest pull-in voltage, which is 201V, and the transmission sound pressure of an element having a highest pull-in voltage, which is 216V. The element having the highest pull-in voltage provides a smaller difference in effective potential between the first electrode and the second electrode and thus the conversion efficiency is lowered, resulting in reduction in transmission sound pressure.

Where a transmission drive voltage that is 14% of the lowest pull-in voltage is provided, the element having the lowest pull-in voltage transmits acoustic waves of 340 kPa, and the element having the highest pull-in voltage transmits acoustic waves of 260 kPa. The transmission sound pressure difference in this case is 80 kPa, and thus, the transmission sound pressure varies in a range of ±13% relative to an average transmission sound pressure value of 300 kPa. Because of the transmission sound pressure variation, a strength of acoustic waves reflected from a test object also varies. When the varying acoustic waves are transmitted from the capacitance transducer and the acoustic waves reflected from the test object are received, a reception bias voltage is applied to the first electrodes 6. In the present comparative example, the transmission bias voltage and the reception bias voltage are equal to each other, and thus a voltage of 160V is applied. As in the application of the transmission bias voltage, the difference in effective potential between the first electrode and the second electrode varies from element to element, and thus the reception sensitivity also varies, and has variation of ±13% when same acoustic waves are received. Where transmission and reception are performed, finally-obtained reception signals have variation of ±26%. In general, variation in an ultrasound probe that performs transmission and reception is preferably ±25% or less in the form of finally-obtained reception signals, and thus, it is difficult to reduce the variation where a transmission bias voltage and a reception bias voltage are equal to each other.

Next, as the present example, transmission driving using the capacitance transducer fabricated as described above where a transmission bias voltage is set to be lower than a reception bias voltage will be described. In the present example, driving is performed with a reception bias voltage set to be 80% of a lowest pull-in voltage and a transmission bias voltage set to be 50% of the lowest pull-in voltage. A transmission bias voltage of 100V is applied to the first electrode 6. Each of transmission drive voltages with a ratio of the transmission drive voltage to the lowest pull-in voltage set to 0.05, 0.1, 0.2, 0.3, 0.4 and 0.49, respectively, is applied to the second electrode 10.

Figure 9A:
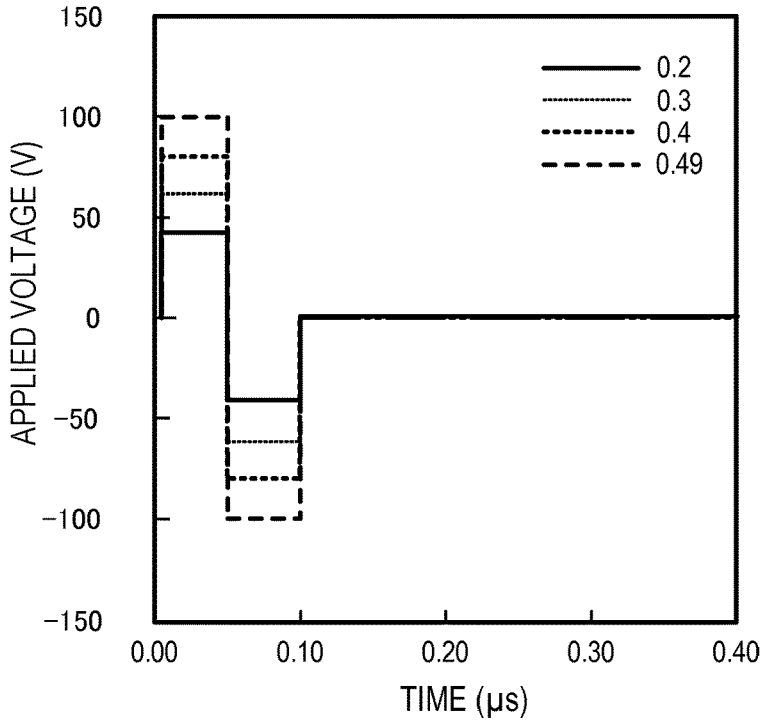
FIG. 9A is a diagram illustrating an example of temporal waveforms of transmission drive voltages for describing Example 1.
Figure 9B:
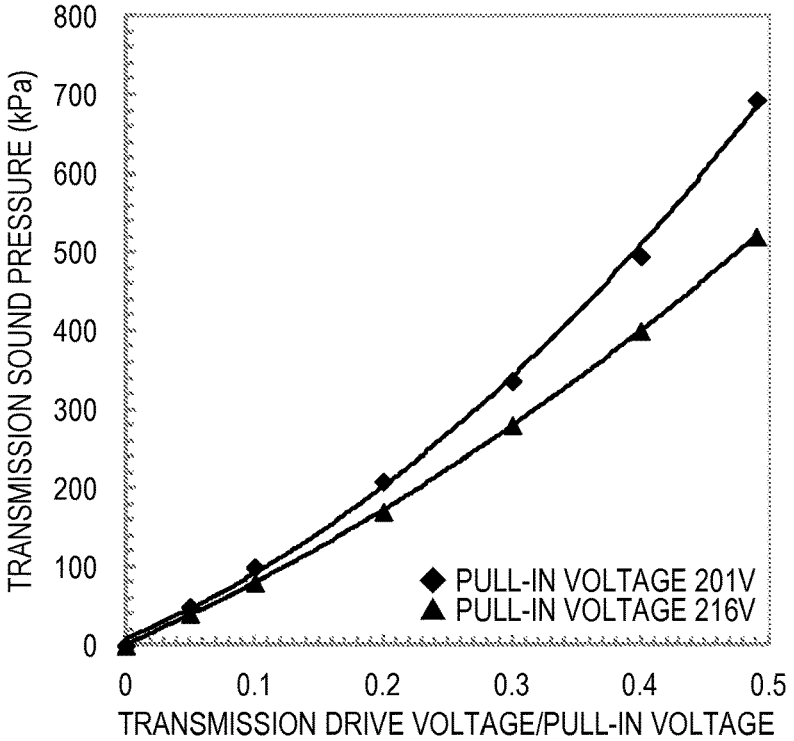
FIG. 9B is a diagram illustrating an example of transmission drive voltage-acoustic wave strength (transmission sound pressure) characteristics for describing Example 1.

FIG. 9A illustrates temporal waveforms of the respective transmission drive voltages. In FIG. 9A, the abscissa axis represents time (μs) and the ordinate axis represents transmission drive voltage (V). Series indicate respective transmission drive voltage ratios of 0.2 to 0.49 relative to the lowest pull-in voltage. The waveform of each of the transmission drive voltages is a bipolar waveform having a pulse width of 45 ns, which is similar to those in FIG. 8A, and an absolute value of each of amplitudes of the positive side and the negative side of the waveform is a transmission drive voltage. FIG. 9B illustrates transmission sound pressure characteristics in this case. The curves in FIG. 9B are second-order polynomial approximate curves of plots in transmission under the respective conditions. The ordinate axis and the abscissa axis in FIG. 9B are similar to those in FIG. 8B. The series in FIG. 9B are also similar to those in FIG. 8B.

In order to obtain a transmission sound pressure of 340 kPa as in the comparative example, a transmission drive voltage of 60V, which is set to be 30% of the lowest pull-in voltage, is applied to the second electrodes 10. An element having the lowest pull-in voltage transmits acoustic waves of 340 kPa and an element having a highest pull-in voltage transmits acoustic waves of 280 kPa. The transmission sound pressure difference in this case is 60 kPa, and thus, the transmission sound pressure varies in a range of ±22.7% relative to an average transmission sound pressure value. In comparison with a case where a reception bias voltage and a transmission bias voltage are equal to each other as in the comparative example, variation in transmission sound pressure can be reduced by setting a transmission bias voltage to be lower than a reception bias voltage as in the present example. Furthermore, in reception operation, as in the comparative example, a reception bias voltage of 160V, which is set to be 80% of the lowest pull-in voltage, is applied to the first electrodes 6. As in the comparative example, variation in reception sensitivity when same acoustic waves are received is ±13%, and thus, variation of reception signals finally obtained when sound pressure is transmitted and acoustic waves reflected from a test object are received as in the present example is ±19.7%. As described above, driving with a transmission bias voltage set to be lower than a reception bias voltage enables reduction in variation in an ultrasound probe that performs transmission and reception.

Although the exemplary embodiment and example of the present invention have been described, the present invention is not limited to these exemplary embodiment and example, and various alternation and modifications are possible within the scope of the spirit of the invention.

According to the present invention, setting a reception bias voltage to be lower than a lowest pull-in voltage of an element group enables the elements in the element group to be driven in a non-pull-in state in reception driving. Furthermore, setting a transmission bias voltage to be lower than a reception bias voltage enables transmission of sound pressure that is higher than sound pressure when driving is performed with transmission and reception bias voltages set to be equal to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-242115, filed on Nov. 22, 2013, which is hereby incorporated by reference herein in its entirety.

What is claimed is:

1. A method for driving a capacitance transducer including an element, the element including a cell having a structure in which a vibration membrane including one electrode of a pair of electrodes formed with a cavity therebetween is supported in such a manner that the vibration membrane can vibrate, the method comprising:

in a mode in which the element that receives acoustic waves, applying a voltage that is lower than a pull-in voltage to the element as a reception bias voltage; and in a mode in which the element transmits an acoustic waves, applying a voltage that is lower than the reception bias voltage to the element as a transmission bias voltage, wherein the transmission bias voltage is set to be not more than one half of the pull-in voltage.

2. The method for driving a capacitance transducer according to claim 1, wherein the capacitance transducer includes a plurality of elements each including the cell.

3. The method for driving a capacitance transducer according to claim 2, wherein variation of reception signals of the acoustic waves in each of the plurality of elements is less than a range of ±25% relative to an average reception signals of the acoustic waves.

4. The method for driving a capacitance transducer according to claim 1, wherein an absolute value of an amplitude of a transmission drive voltage is set to be lower than the transmission bias voltage.

5. The method for driving a capacitance transducer according to claim 1, wherein in the mode in which the element transmits the acoustic waves, a voltage obtained by superimposing a transmission drive voltage on the transmission bias voltage is applied to the element; and wherein an absolute value of an amplitude of the transmission drive voltage is lower than a difference between the pull-in voltage and the transmission bias voltage.

6. The method for driving a capacitance transducer according to claim 5, wherein a sum of the transmission bias voltage and the absolute value of the amplitude of the transmission drive voltage is set to be more than the reception bias voltage.

7. The method for driving a capacitance transducer according to claim 5, wherein a waveform of the transmission drive voltage is a bipolar pulse.

8. The method for driving a capacitance transducer according to claim 5, wherein the capacitance transducer performs transmission and reception of the acoustic waves by vibration of the vibration membrane including one electrode of the pair of electrodes, and wherein a waveform of the transmission drive voltage applied to the electrode included in the vibration membrane is set to the waveform in which positive voltage is firstly applied and then negative voltage is applied in a condition that negative voltage is applied to the other electrode of the pair of electrodes.

9. A device for driving a capacitance transducer including an element, the element including a cell having a structure in which a vibration membrane including one electrode of a pair of electrodes formed with a cavity therebetween is supported in such a manner that the vibration membrane can vibrate, the device comprising a voltage control unit that controls a voltage to be applied between the pair of electrodes, wherein in a mode in which the element receives acoustic waves, the voltage control unit applies a voltage that is lower than a pull-in voltage as a reception bias voltage; and wherein in a mode in which the element transmits acoustic waves, the voltage control unit applies a voltage that is lower than the reception bias voltage to the element as a transmission bias voltage, wherein the transmission bias voltage is set to be not more than one half of the pull-in voltage.

10. A test object information obtaining apparatus comprising:

a capacitance transducer driven by a drive device according to claim 9; and a processing unit that obtains information on a test object using an electric signal output from the capacitance transducer, wherein the capacitance transducer receives acoustic waves from the test object and outputs the electric signal.

11. The device for driving a capacitance transducer according to claim 9, wherein in the mode in which the element transmits the acoustic waves, the voltage control unit applies a voltage obtained by superimposing a transmission drive voltage on the transmission bias voltage to the element; and wherein an absolute value of an amplitude of the transmission drive voltage is set to be lower than a difference between the pull-in voltage and the transmission bias voltage.

12. The device for driving a capacitance transducer according to claim 11, wherein a sum of the transmission bias voltage and the absolute value of the amplitude of the transmission drive voltage is set to be more than the reception bias voltage.

13. The device for driving a capacitance transducer according to claim 11, wherein a waveform of the transmission drive voltage is a bipolar pulse.

14. The device for driving a capacitance transducer according to claim 9, wherein an absolute value of an amplitude of a transmission drive voltage is set to be lower than the transmission bias voltage.

15. The device for driving a capacitance transducer according to claim 14, wherein the capacitance transducer performs transmission and reception of the acoustic waves by vibration of the vibration membrane including one electrode of the pair of electrodes, and wherein an waveform of the transmission drive voltage applied to the electrode included in the vibration membrane is set to the waveform in which positive voltage is firstly applied and then negative voltage is applied in a condition that negative voltage is applied to the other electrode of the pair of electrodes.

16. The device for driving a capacitance transducer according to claim 9, further comprising a switch unit that switches over between the transmission bias voltage in the mode in which the element transmits the acoustic waves and the reception bias voltage in the mode in which the element receives the acoustic waves, wherein the switch unit performs switching so as to apply the transmission bias voltage from the voltage control unit to the element in driving for transmission, and to apply the reception bias voltage from the voltage control unit to the element in driving for reception.

17. The device for driving a capacitance transducer according to claim 9, wherein the capacitance transducer includes a plurality of elements each including the cell.

18. The device for driving a capacitance transducer according to claim 17, wherein variation of the acoustic waves which receives in each a plurality of elements is less than a range of ±25% relative to an average reception signals.

* * * * *